US007134784B1

(12) United States Patent
Marin

(10) Patent No.: US 7,134,784 B1
(45) Date of Patent: Nov. 14, 2006

(54) ROTATING BEZEL WATCH

(76) Inventor: James Marin, 2551 Ocean Ave., Seaford, NY (US) 11783

( * ) Notice: Subject to any disclaimer, the term of this patent is extended or adjusted under 35 U.S.C. 154(b) by 241 days.

(21) Appl. No.: 10/750,511

(22) Filed: Dec. 31, 2003

(51) Int. Cl.
*G04B 39/00* (2006.01)

(52) U.S. Cl. ..... 368/295; 368/238

(58) Field of Classification Search ..... 368/294–296, 368/27, 15–20, 233, 88, 281, 238
See application file for complete search history.

(56) References Cited

U.S. PATENT DOCUMENTS

| | | | | |
|---|---|---|---|---|
| 246,061 | A * | 8/1881 | Blair | 368/16 |
| 3,271,945 | A | 9/1966 | Anderson | |
| 3,431,722 | A | 3/1969 | Haas | |
| 3,757,513 | A | 9/1973 | Tokunaga | |
| 3,810,354 | A * | 5/1974 | Naikaido et al. | 368/156 |
| 4,067,186 | A | 1/1978 | Grohoski et al. | |
| 4,253,177 | A | 2/1981 | Hafner | |
| 4,435,795 | A * | 3/1984 | Frank | 368/16 |
| 4,734,895 | A * | 3/1988 | Grosskopf | 368/229 |
| 4,975,893 | A | 12/1990 | Dal Busco | |
| 5,122,997 | A | 6/1992 | Schneider et al. | |
| 5,237,546 | A | 8/1993 | Vollert | |
| 5,321,670 | A | 6/1994 | Rebeaud et al. | |
| 5,541,895 | A | 7/1996 | Nussbaum | |
| 6,565,253 | B1 * | 5/2003 | Yang | 368/294 |
| 2001/0040840 | A1 | 11/2001 | Terasawa et al. | |
| 2003/0123332 | A1 | 7/2003 | Hiranuma et al. | |

FOREIGN PATENT DOCUMENTS

| | | |
|---|---|---|
| GB | 1.537.636 | 11/1977 |
| GB | 2.115.954 | 9/1983 |

* cited by examiner

*Primary Examiner*—Kamand Cuneo
*Assistant Examiner*—Sean Kayes
(74) *Attorney, Agent, or Firm*—Michael I Kroll

(57) ABSTRACT

The present invention discloses a rotating bezel watch including a watch face having an hour hand, minute hand and second hand connected at substantially a center of thereof and a rotatable bezel connected to the watch face. The watch further includes means for rotating the rotatable bezel, wherein the rotating means rotates the rotatable bezel about the watch face to increase the visual attractiveness of the watch face.

15 Claims, 18 Drawing Sheets

ROTATING BEZEL WATCH

BACKGROUND OF THE INVENTION

1. Field of the Invention

The present invention relates generally to wristwatch devices, and more specifically, to a bezel that rotates in conjunction with the moving hands of a wristwatch. The bezel is preferably connected by a plurality of arms to the second hand gear of the wristwatch for providing means for the bezel to rotate. In an alternate configuration of the present invention, the bezel is connected to an independent gear for providing independent means for the bezel to rotate. In yet another preferred element of the present invention, the wristwatch includes a button to enable and disable the bezel rotational movement. The rotating bezel provides new styling in fashion and design whereas gems, insignia, or other items affixed to the bezel are used to attract attention. When light hits the surface of the bezel and affixed items such as gems, the rotational motion provides means to enhance the shine and gleam.

2. Description of the Prior Art

There are other timepieces having rotary members. Typical of these is U.S. Pat. Nos. 3,271,945, 3,431,722, 3,757,513, 4,067,186, 4,253,177, 4,975,893, 5,122,997, 5,237,546, 5,321,670, 5,541,895, U.S. Publication Nos. 2001/0040840 A1 and 2003/0123332, and U.K. Patent No. 1,537,636. While these wristwatch rotatable bezels may be suitable for the purposes for which they were designed, they would not be suitable for the purpose of the present invention, as hereinafter described.

U.S. Pat. No. 3,271,945

Inventor: David H. Anderson

Issued: Sep. 13, 1966

An object of the invention is to provide a watch casing that may be used for a prolonged period without significant wear or change in tension. Still another object of the invention is to provide a sturdy watch casing in which the rotatable bezel is effectively locked to the casing. Yet another object of the invention is to provide a sub-assembly, which includes a holding ring for the watch crystal, a rotatable bezel, as well as spring and friction elements, whereby the sub-assembly facilitates final factory assembly of the watch and ready replacement in the field. A further advantage of the invention is that the rotation friction on the rotatable bezel can be regulated to a fine degree.

U.S. Pat. No. 3,431,722

Inventor: Peter Haas

Issued: Mar. 11, 1969

Timepiece case having outside its crystal two concentric graduated bezels rotatably mounted on the case by means of a spring housed in two annular grooves, one made in the bezel the other made in the case in such away that the two bezels can turn independently one of the other for the purpose of making slide rule calculations and wherein one of the annular grooves of the case cooperating with the outer bezel is disposed at least partially under the inner bezel.

U.S. Pat. No. 3,757,513

Inventor: Ikuo Tokunaga

Issued: Sep. 11, 1973

A wrist watch having a cursor ring rotatably mounted thereon, the cursor being formed with a first laterally projecting portion having a cursor line thereon for setting scales on the watch, and a second projecting portion for manual engagement for the selective rotation and positioning of the cursor ring. A bezel having graduations on its surface may be rotatably mounted relative to a fixed graduated circle on the watch with the first projecting portion of the cursor ring in overlapping relation therewith.

U.S. Pat. No. 4,067,186

Inventor: Raymond J. Grohoski et al.

Issued: Jan. 10, 1978

In a timepiece, a supplementary watch crystal is mounted over the regular watch crystal so as to be manually rotatable with respect to the regular watch crystal. The supplementary watch crystal may then be provided with special marking indicia or constructed of special material to achieve special visual effects when used in conjunction with other devices in a timepiece such as a rotatable bezel ring or rotatable "seconds" disc with markings thereon. Modified forms of the invention include a bezel extension formed on the supplementary crystal, or a second supplementary crystal mounted on the first supplementary crystal. The supplementary crystal is preferably mounted by an inner circumferential lip on the supplementary crystal disposed in an outer circumferential groove on the regular watch crystal.

U.S. Pat. No. 4,253,177

Inventor: Dieter Hafner

Issued: Feb. 24, 1981

An actuating element for the manual adjustment of a clock comprises a rotating collar face which is arranged around the time indicating device of the clock. In a mechanical or electromechanical clock, the rotating movement of the rotating collar face is transmitted through gearing to the dial train of the clock. In an electronic clock pulse-producing elements are arranged on the collar and pulse-receiving elements are fixed in the clock to produce individual pulses or pulse trains which can be counted in according to the backward counting input of the time storage which is in operative connection with the indicating element of the clock.

U.S. Pat. No. 4.975,893

Inventor: Giancarlo Dal Busco

Issued: Dec. 4, 1990

The rotating metal rim is equipped with a toothed ring made of synthetic material catch-fastened to the rotating rim and catch-mounted on the frame or by means of a band. The toothing of the ring cooperates with at least one pawl mounted in a recess of the frame and held in place on the one hand by a foot and on the other hand by the rotating rim itself. The mounting of the unit and the after-sales service are facilitated.

U.S. Pat. No. 5,122,997

Inventor: Henri Schneider et al.

Issue: Jun. 16, 1992

The watch bezel is mounted on the middle part of the case by means of a wave-shaped inclined spring wire. Between the middle part of the case and the bezel is located a flat spring having inclined tongues forming pawls engaging into the toothing of a toothed ring. This ring is freely located between the middle part of the case and the bezel, and its angular position relatively to the bezel is determined by pins engaging into holes of the bezel. The indexing system of the bezel composed of the toothed ring and of the flat spring with its pawls is thus freely disposed between the bezel and the middle part of the case, and all constituents are maintained in place only by spring force of springs. The elements of the system and its assemblage are particularly simple and inexpensive.

U.S. Pat. No. 5,237,546

Inventor: Alfred Vollert

Issued: Aug. 17, 1993

This watch case includes an assembly capable of being rotatively driven relative to a caseband, the assembly including a bezel exhibiting an interior shoulder, a crystal and an annular element forming a flange. A packing is interposed between the bezel and the caseband. A casing ring is arranged within the caseband so as to receive a movement. The ring exhibits an annular rib resting on the bezel shoulder so as to retain the assembly on the caseband.

U.S. Pat. No. 5,321,670

Inventor: Jean-Philippe Rebeaud et al.

Issued: Jun. 14, 1994

A timepiece includes a case, a crystal fixedly mounted on the case and a rotatable bezel guided in rotation relative to the crystal and the case, the bezel furthermore being associated with a ratchet mechanism and is characterized in that the bezel includes sealing means against solid impurities, such means being intended to isolate at least the ratchet mechanism from the exterior and to prevent solid impurities from becoming embedded at least between the bezel and the crystal and in that it additionally includes means enabling the driving of such impurities towards the exterior of the timepiece.

U.S. Pat. No. 5,541,895

Inventor: Augustin Nussbaum

Issued: Jul. 30, 1996

A rotating bezel is hooked on a fixed ring intended to be fixed to the frame of the casing. This bezel comprises a toothed rack in which is engaged the free end of a positioning spring-wire whose other end is elbowed and engaged in a hole of the fixed ring. This spring-wire comprises three segments, two end segments practically straight and tangential to a circle concentric with the bezel and an intermediate curved segment with its center of curvature inside the bezel but of radius substantially smaller than that of the bezel. The shape of the spring permits the forces necessary to rotate the bezel in the two directions to be made practically equal.

U.S. Patent Application Number: 2001/0040840 A1

Inventor: Dai Terasawa et al.

Issued: Nov. 15, 2001

The rotary vessel is structured having a function movable generally vertical relative to a plane of a wristwatch case and divided with a plurality of stop points in a movable range in a vertical direction, i.e. a stop point for securing stop stability of rotation and a stop point for rotating the rotary vessel. Due to this, in the case that the rotary vessel is in a rotatable state, rotation torque can be minimized.

U.S. Patent Application Number: 2003/0123332 A1

Inventor: Haruki Hiranuma et al.

Issued: Jul. 3, 2003

To provide a rotating type bezel apparatus in which there is not actually a concern that the apparatus is rotated unpreparedly after having been positioned and a portable timepiece having the rotating bezel apparatus. A rotating type bezel apparatus of a portable timepiece includes a case body, a bezel mounted to the case body rotatably around a central axis line of the case body and having recesses and projections at regular angular intervals along a peripheral direction, a click spring mounted to the case body elastically engageably to the recesses and projections of the bezel at a front end portion to give a click feeling in rotating the bezel, and a stopper mounted to the case body movably in B1 and B2 directions between an engagement release prohibiting position E2 prohibiting to release the engagement between the front end portion of the click spring and the recesses and projections of the bezel and an engagement release permitting position E1 for permitting to release the engagement.

U.K. Patent Number: 1 537 636

Inventor: Times Corporation

Issued: Jan. 10, 1979

In a timepiece, a supplementary watch crystal is mounted over the regular watch crystal so as to be manually rotatable with respect to the regular watch crystal. The supplementary watch crystal may then be provided with special marking indicia or constructed of special material to achieve special visual effects when used in conjunction with other devices in a timepiece such as a rotatable bezel ring or rotatable "seconds" disc with markings thereon. Modified forms of the invention include a bezel extension formed on the supplementary crystal, or a second supplementary crystal mounted on the first supplementary crystal. The supplementary crystal is preferably mounted by an inner circumferential lip on the supplementary crystal disposed in an outer circumferential groove on the regular watch crystal.

U.K. Patent Number: GB 2 115 954 A

Inventor: Harwell B. Thompson

Issued: Sep. 14, 1983

A plastic strap and bezel are molded from plastic material to provide a bezel section and integrated flexible strap sections. The bezel is adapted to retain a bell-shaped crystal of transparent plastic with a central viewing portion. The crystal has a depending wall portion arranged to receive a caseback of metal or plastic with a water-resistant seal. The crystal wall portion includes an integral pendant for the stem or push button, and has ears or lugs, which are molded into the bezel or, which snap into bezel recesses.

SUMMARY OF THE PRESENT INVENTION

The present invention relates generally to wristwatch devices, and more specifically, to a bezel that rotates in conjunction with the moving hands of a wristwatch. The bezel is preferably connected by a plurality of arms to the second hand gear of the wristwatch for providing means for the bezel to rotate. In an alternate configuration of the present invention, the bezel is connected to an independent gear for providing independent means for the bezel to rotate. In yet another preferred element of the present invention, the wristwatch includes a button to enable and disable the bezel rotational movement. The rotating bezel provides new styling in fashion and design whereas gems, insignia, or other items affixed to the bezel are used to attract attention. When light hits the surface of the bezel and affixed items such as gems, the rotational motion provides means to enhance the shine and gleam.

A primary object of the present invention is to provide a wristwatch that overcomes the shortcomings of the prior art.

Another object of the present invention is to provide a wristwatch having an automated rotating bezel.

Yet another object of the present invention is to provide a wristwatch wherein the automated rotating bezel is connected by a plurality of radial arms to the second hand gear of the timepiece.

Still yet another object of the present invention is to provide a wristwatch wherein the automated rotating bezel is connected by a plurality of radial arms to an independent gear in the timepiece.

A further object of the present invention is to provide a wristwatch wherein the independent gear includes a gear ratio that drives the bezel at a velocity less than the second hand.

Yet a further object of the present invention is to provide a wristwatch wherein the independent gear includes a gear ratio that drives the bezel at a velocity equivalent to the second hand.

Still yet a further object of the present invention is to provide a wristwatch wherein the independent gear includes a gear ratio that drives the bezel at a velocity greater than the second hand.

Yet another additional object of the present invention is to provide a wristwatch wherein the independent gear drives the bezel in the same direction as the second hand.

Still yet another additional object of the present invention is to provide a wristwatch wherein the independent gear drives the bezel in the opposite direction as the second hand.

An additional object of the present invention is to provide a wristwatch having a button to enable or disable the automated rotating bezel.

A further object of the present invention is to provide a wristwatch wherein the automated rotating bezel includes an interchangeable faceplate.

Yet a further object of the present invention is to provide a wristwatch wherein the automated rotating bezel includes light emitting diodes (LEDs) thereon.

Still yet a further object of the present invention is to provide a wristwatch wherein the automated rotating bezel includes cartoon characters thereon.

An additional object of the present invention is to provide a wristwatch having a manually rotating and interchangeable faceplate.

Yet another object of the present invention is to provide a wristwatch having glow in the dark bezel and faceplate members.

A further object of the present invention is to provide a wristwatch that is simple and easy to use.

Yet a further object of the present invention is to provide a wristwatch that is inexpensive to manufacture and maintain.

Additional objects of the present invention will appear as the description proceeds.

The present invention overcomes the shortcomings of the prior art by providing a bezel that rotates in conjunction with the moving hands of a wristwatch. The bezel is preferably connected by a plurality of arms to the second hand gear of the wristwatch for providing means for the bezel to rotate. The bezel may also be connected to an independent gear for providing independent means for the bezel to rotate. The wristwatch preferably includes a button to enable and disable the rotation of the bezel. Preferably, the rotating bezel is decorated with gems, insignia, or other items affixed to the bezel for attracting attention. When light hits the surface of the bezel and affixed items such as gems, the rotational motion provides means to enhance the shine and gleam.

The foregoing and other objects and advantages will appear from the description to follow. In the description reference is made to the accompanying drawings, which forms a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWING FIGURES

In order that the invention may be more fully understood, it will now be described, by way of example, with reference to the accompanying drawing in which.

DESCRIPTION OF THE REFERENCED NUMERALS

Figure 1:
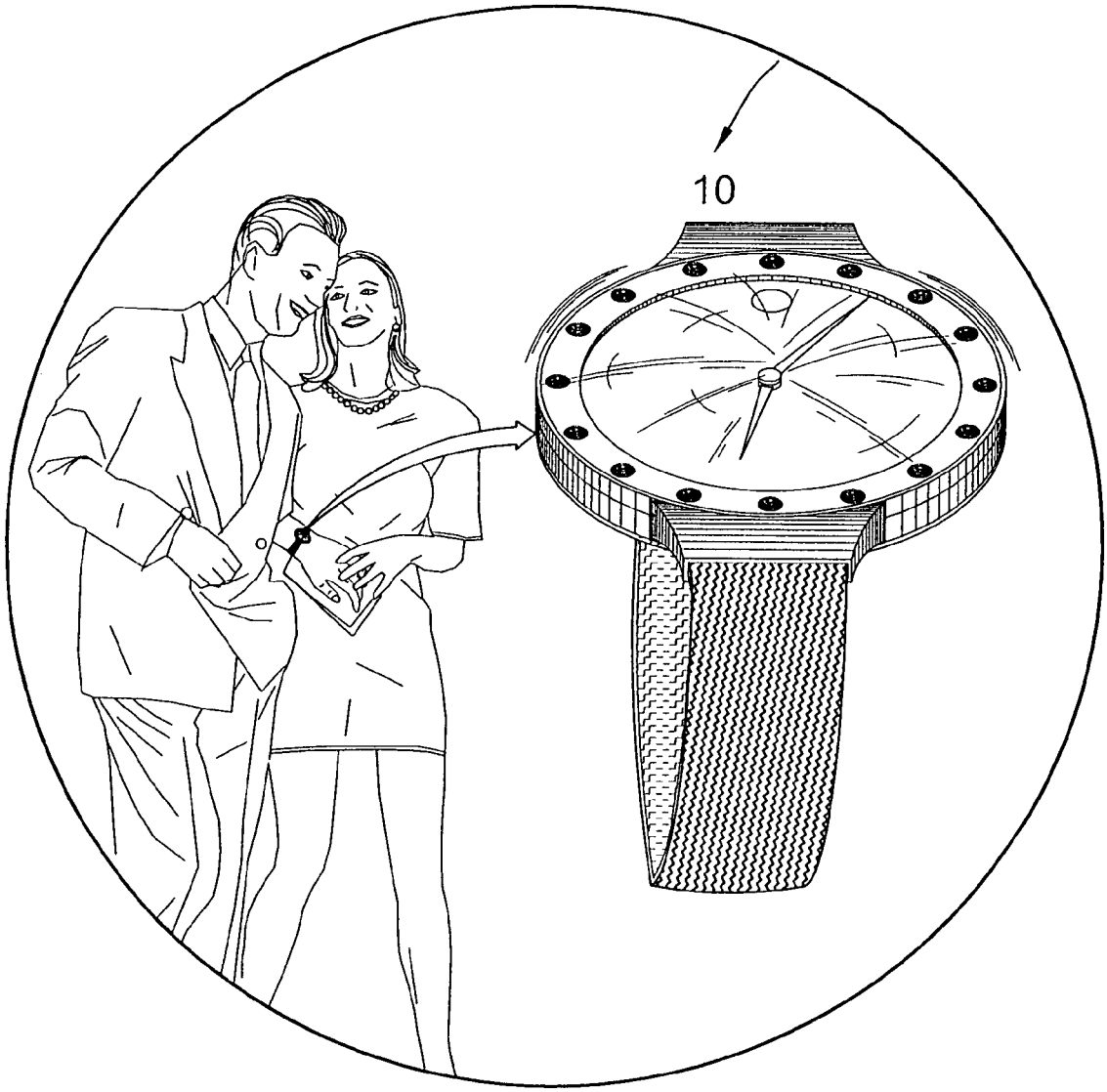
FIG. 1 is an illustrative view of the rotating bezel watch of the present invention in use.

Turning now descriptively to the drawings, in which similar reference characters denote similar elements throughout the several views, the Figures illustrate the rotating bezel watch of the present invention. With regard to the reference numerals used, the following numbering is used throughout the various drawing Figures.

10 rotating bezel watch of the present invention
12 watch face
14 rotating bezel
16 watch band
18 transparent cover
20 hour hand
22 second hand
24 decorative gems
26 support arm
28 second hand gear
30 power source
32 minute hand
34 bezel channel
36 snap fastener
38 additional drive gear
40 bezel disconnect button
42 bezel drive gear
44 transitional gear
46 geared bezel cylinder
48 transparent cover support
50 alternate bezels
52 cylinder channel
54 alternate geared bezel cylinder
56 gear teeth
58 light emitting diode
60 rotating bezel face plate
62 fixed number plate

DETAILED DESCRIPTION OF THE PREFERRED EMBODIMENT

The following discussion describes in detail one embodiment of the invention and several variations of that embodiment. This discussion should not be construed, however, as limiting the invention to those particular embodiments. Practitioners skilled in the art will recognize numerous other embodiments as well. For definition of the complete scope of the invention, the reader is directed to appended claims.

Turning now descriptively to the drawings, in which similar reference characters denote similar elements throughout the several views, FIGS. 1 through 18 illustrate an rotating bezel watch of the present invention indicated generally by the numeral 10.

FIG. 1 is an illustrative view of the rotating bezel watch 10 of the present invention in use. The present invention provides a watch including a rotatable bezel decorated with, for example, decorative gems. More specifically, the present invention is a wristwatch timepiece including a watch face connected to a watch band, wherein a movable bezel is connected to the second hand gear of the timepiece. Therefore, the movable bezel moves in conjunction with the second hand of the timepiece. The invention provides a novel, fun addition to the wristwatch and contributes to appearance.

Figure 2:
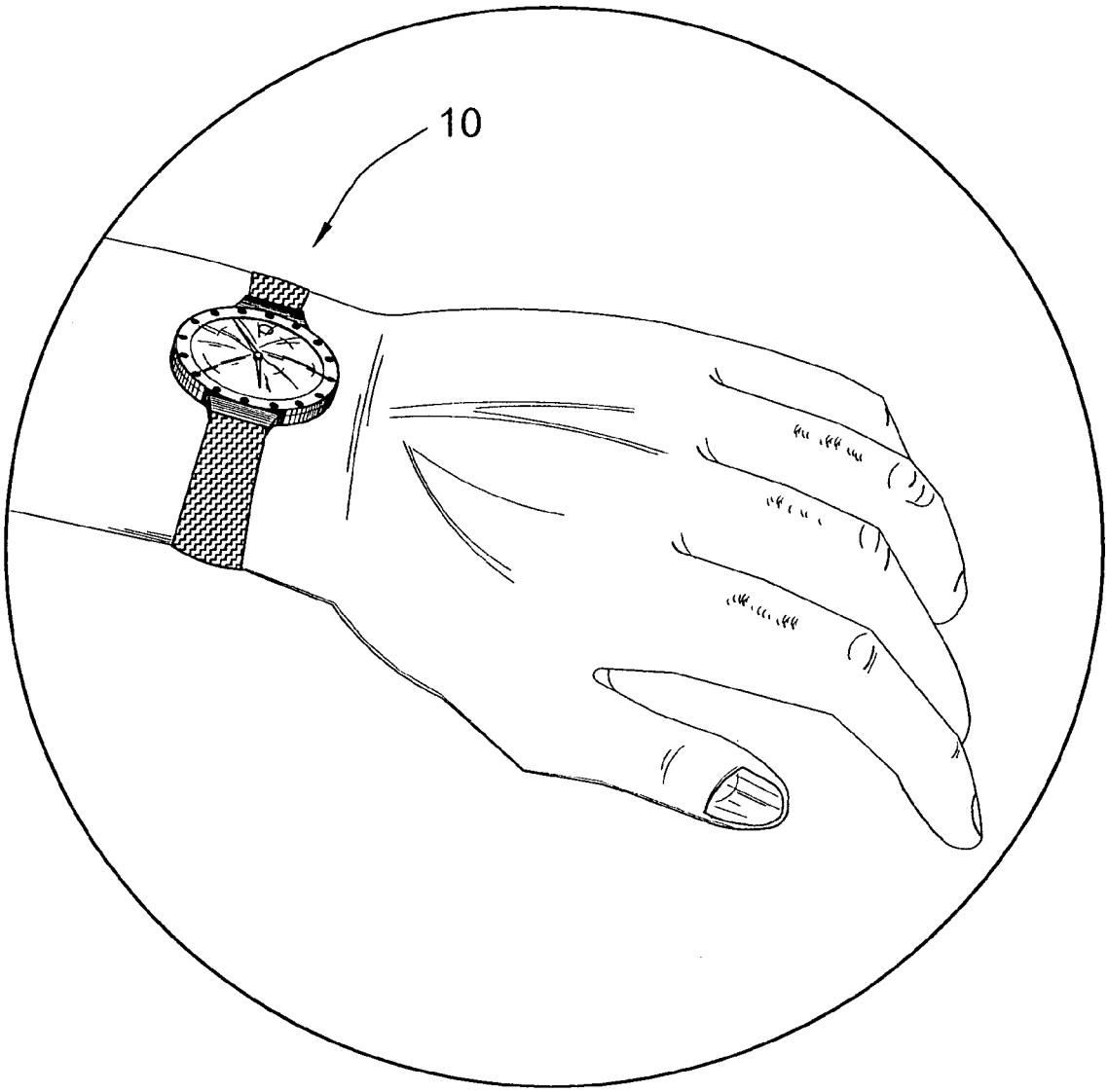
FIG. 2 is an illustrative view of the rotating bezel watch of the present invention in use.

FIG. 2 is an illustrative view of the rotating bezel watch of the present invention in use. The present invention provides a watch including a rotatable bezel decorated with, for example, decorative gems. More specifically, the present invention is a wristwatch timepiece including a watch face connected to a watch band, wherein a bezel is interlinked to the gears of the timepiece and moves in conjunction with the second hand of the timepiece. The invention provides a novel, fun addition to the wristwatch and contributes to appearance.

Figure 3:
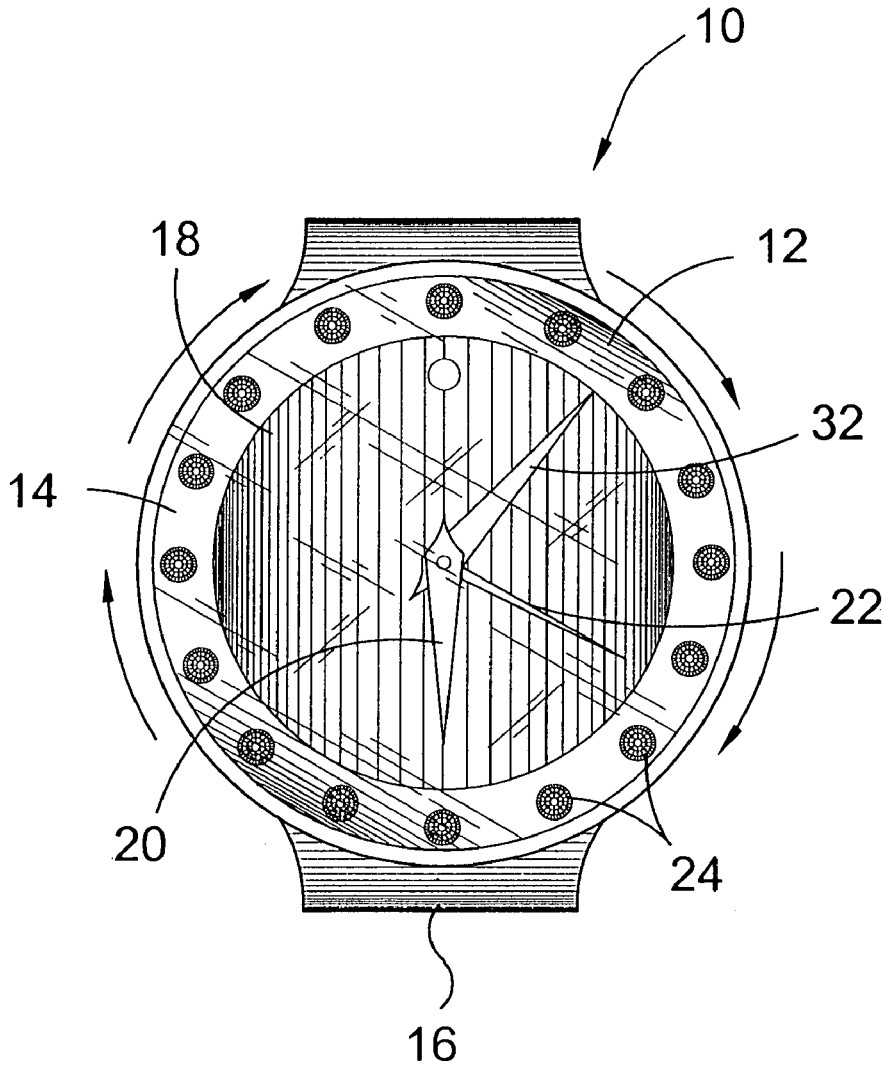
FIG. 3 is a front view of the rotating bezel watch of the present invention.
Figure 4:
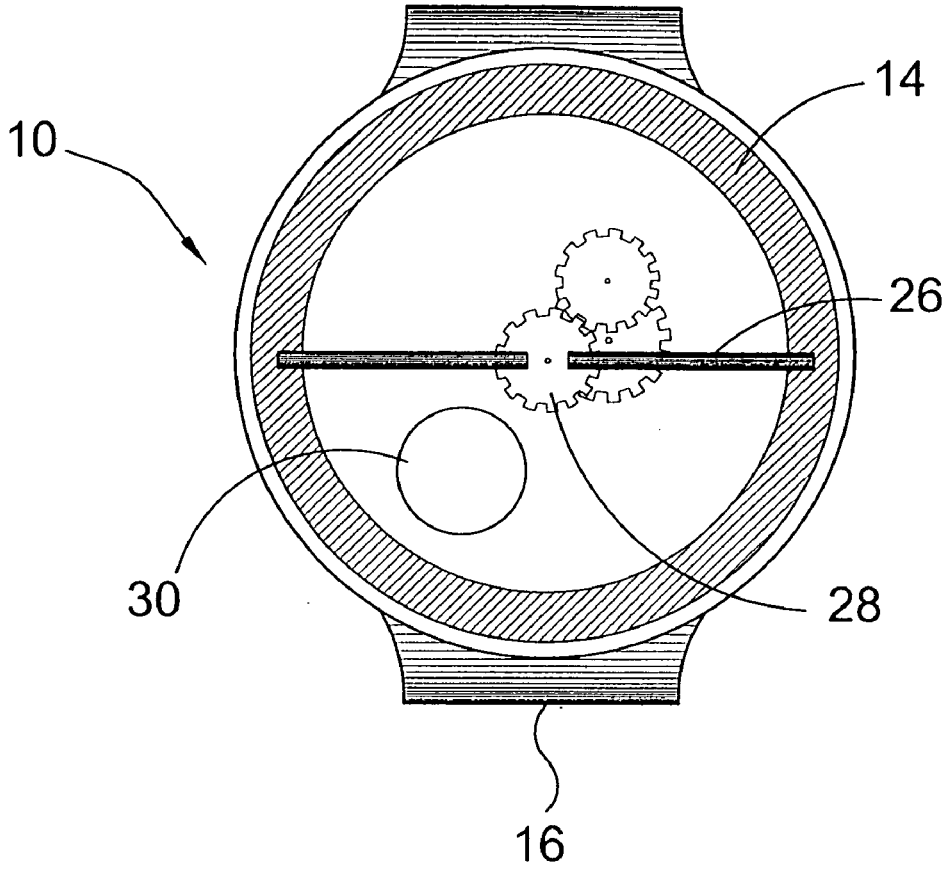
FIG. 4 is a rear view of the rotating bezel watch of the present invention.

FIG. 3 is a front view of the rotating bezel watch 10 of the present invention. The rotating bezel watch 10 includes a watch face 12 connected to a watch band fastener 16 for positioning on a wrist of a user. An hour hand 20, second hand 22, and minute hand 32 are connected at one end of each to substantially the center of the watch face 12. Each of the hour hand 20, second hand 22 and minute hand 32 rotate in a clockwise direction around the watch face 12, as is typical in the art. A transparent cover 18 covers and protects the watch face 12. In a preferred embodiment, the transparent cover 18 is formed from crystal. The present invention includes means for rotating the rotatable bezel 14 wherein the rotatable bezel 14 rotates in a circular motion about the watch face 12. Preferably, the rotatable bezel 14 is connected to a second hand gear 28, as shown in FIG. 4. Therefore, the rotatable bezel 14 rotates about the watch face 12 in conjunction with the rotation of the second hand 22. Preferably, the rotatable bezel 14 is decorated with decorative gems 24 for enhancing the shine and gleam of the watch face 12.

FIG. 4 is a front sectional view of the rotating bezel watch 10 of the present invention. The rotating bezel watch 10 includes the watch face 12 connected to the watch band fastener 16 for positioning on the wrist of a user, as shown in FIGS. 1–3. The present invention includes means for rotating the rotatable bezel 14 wherein the rotatable bezel 14 rotates in a circular motion about the watch face 12, as shown in FIG. 3. In a preferred embodiment, the rotatable bezel 14 is connected to support arms 26. The support arms 26 are connected to the second hand gear 28. A power source 30 provides power for moving the second hand gear 28 in a clockwise motion in accordance with the movement of the second hand as in a conventional timepiece. Therefore, the rotatable bezel 14 rotates around the watch face 12 in conjunction with the rotation of the second hand gear 28 and second hand 22, as shown in FIG. 3. Preferably, the rotatable bezel 14 is decorated with decorative gems 24 for enhancing the shine and gleam of the watch face 12.

Figure 5:
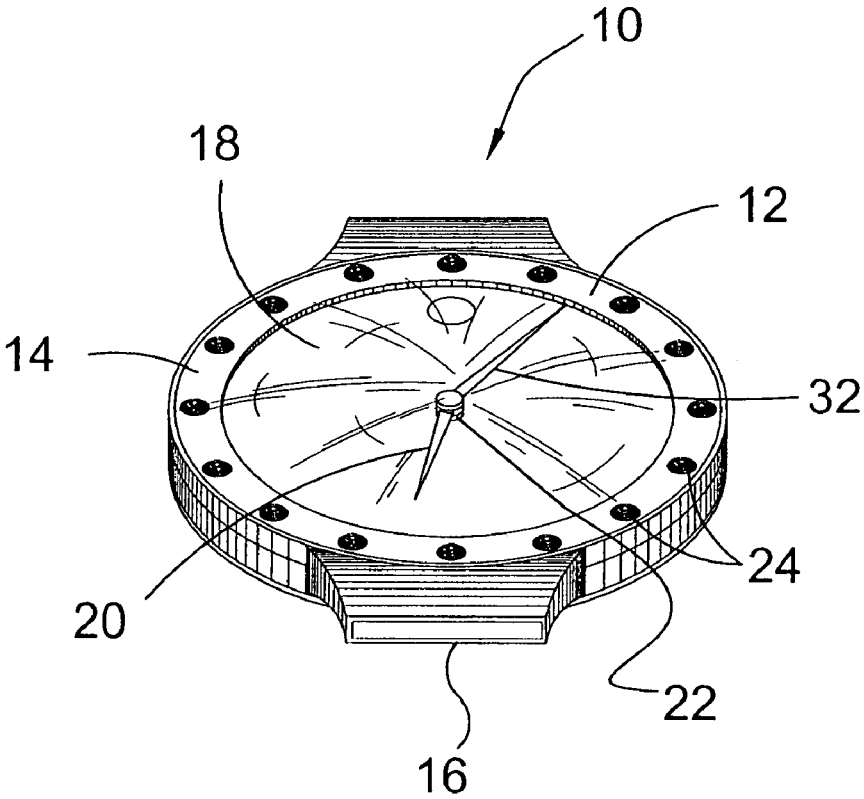
FIG. 5 is a perspective view of the rotating bezel watch of the present invention.

FIG. 5 is a perspective view of the rotating bezel watch 10 of the present invention. The rotating bezel watch 10 includes the watch face 12 connected to the watch band fastener 16 for positioning on the wrist of a user. The hour hand 20, second hand 22, and minute hand 32 are connected at one end of each to substantially the center of the watch face 12. Each of the hour hand 20, second hand 22 and minute hand 32 rotate in a clockwise direction around the watch face 12, as is typical in the art. The transparent cover 18 covers and protects the watch face 12. In a preferred embodiment, the transparent cover 18 is formed from crystal. The present invention includes means for rotating the rotatable bezel 14 wherein the rotatable bezel 14 rotates in a circular motion about the watch face 12. Preferably, the rotatable bezel 14 is connected to a second hand gear 28, as shown in FIG. 4. Therefore, the rotatable bezel 14 rotates about the watch face 12 in conjunction with the rotation of the second hand 22. Preferably, the rotatable bezel 14 is decorated with decorative gems 24 for enhancing the shine and gleam of the watch face 12.

Figure 6:
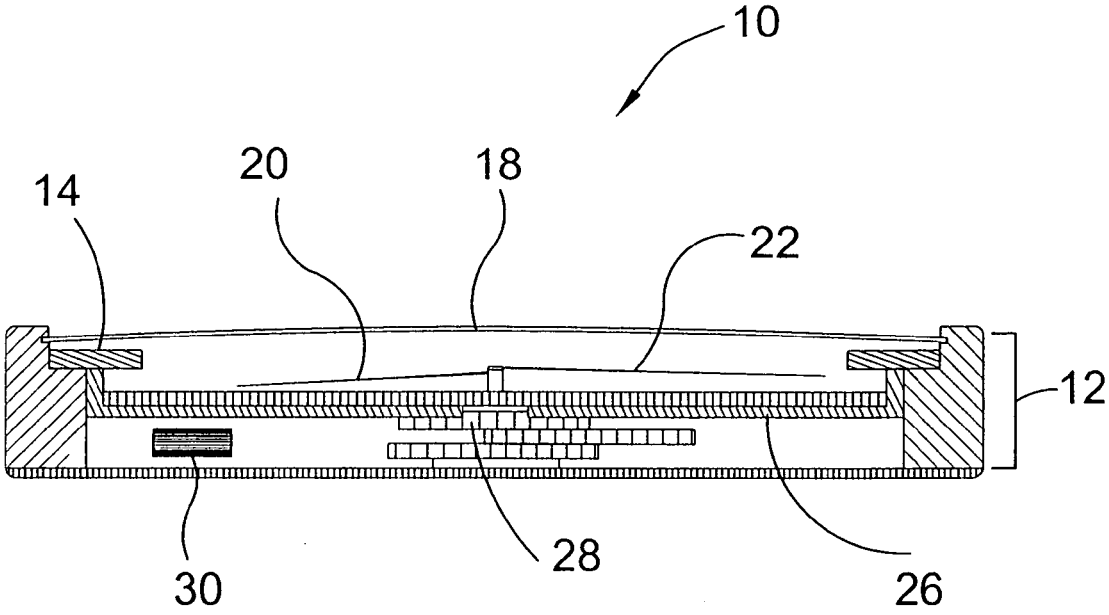
FIG. 6 is a sectional view of the rotating bezel watch of the present invention.

FIG. 6 is a cross sectional view of the rotating bezel watch 10 of the present invention. The rotating bezel watch 10 includes the watch face 12 connected to the watch band fastener 16 for positioning on the wrist of a user. The hour hand 20, second hand 22, and minute hand 32 are connected at one end of each to substantially the center of the watch face 12. Each of the hour hand 20, second hand 22 and minute hand 32 rotate in a clockwise direction around the watch face 12, as is typical in the art. The transparent cover 18 covers and protects the watch face 12. In a preferred embodiment, the transparent cover 18 is formed from crystal. The present invention includes means for rotating the rotatable bezel 14 wherein the rotatable bezel 14 rotates in a circular motion about the watch face 12. Preferably, the rotatable bezel 14 is connected to a second hand gear 28, as shown in FIG. 4. Therefore, the rotatable bezel 14 rotates about the watch face 12 in conjunction with the rotation of the second hand 22. Preferably, the rotatable bezel 14 is decorated with decorative gems 24 for enhancing the shine and gleam of the watch face 12.

Figure 7:
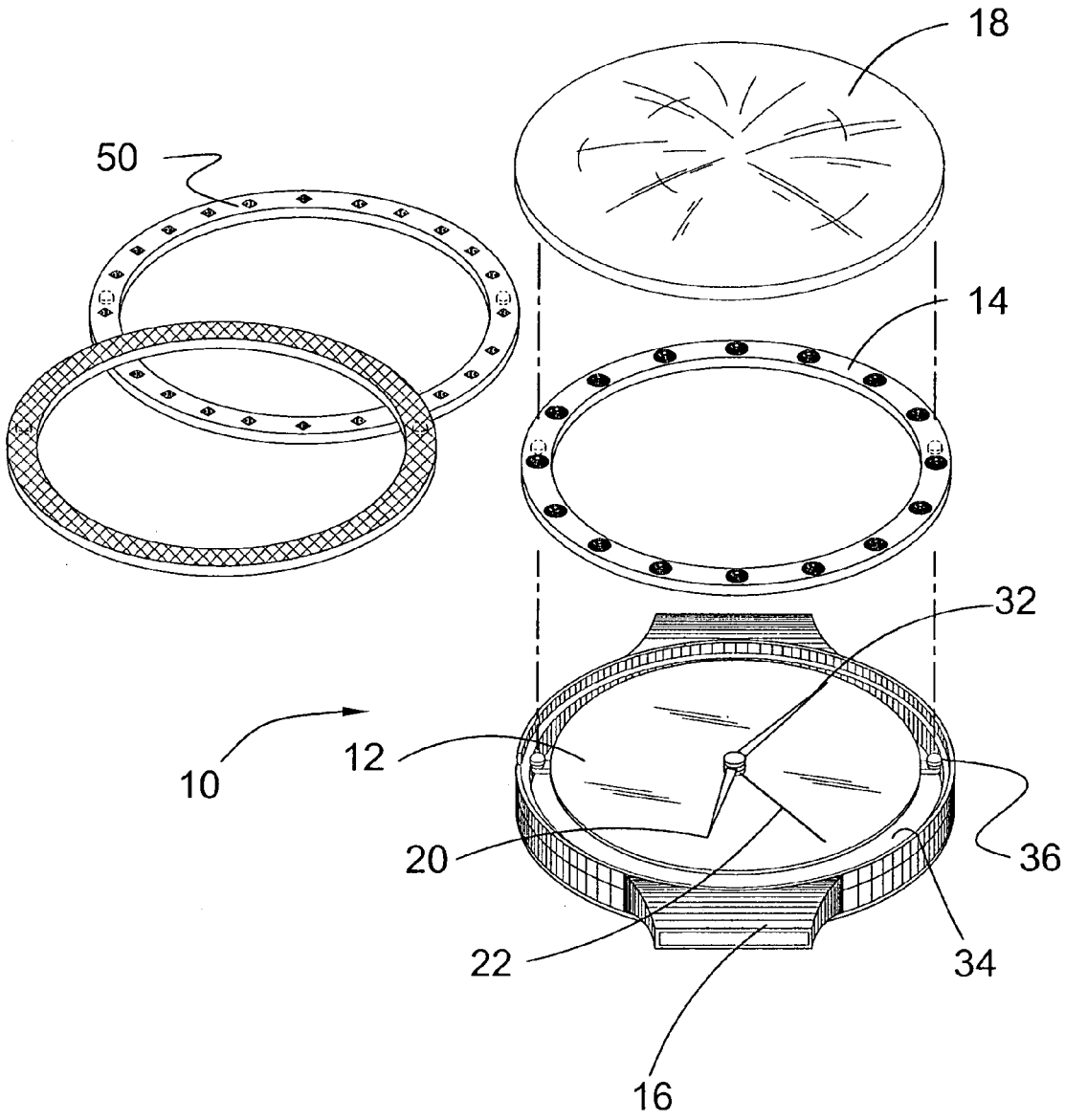
FIG. 7 is a perspective view of an alternate embodiment of the rotating bezel watch of the present invention.

FIG. 7 is a perspective view of an alternate embodiment of the rotating bezel watch 10 of the present invention. The rotating bezel watch 10 includes the watch face 12 connected to the watch band fastener 16 for positioning on the wrist of a user. The hour hand 20, second hand 22, and minute hand 32 are connected at one end to substantially the center of the watch face 12 and rotate in a clockwise direction about the watch face 12. The transparent cover 18 covers and protects the watch face 12. In a preferred embodiment, the transparent cover 18 is formed from crystal. The present invention includes means for rotating the rotatable bezel 14 wherein the rotatable bezel 14 rotates in a circular motion about the outside of the watch face 12. The rotatable bezel 14 is connected to the second hand gear 28, as shown in FIG. 4. Support arms 26 are preferably connected to the second hand gear 28, as shown in FIG. 4. Snap fasteners 36 are positioned on the distal ends of the support arms 26. The rotatable bezel 14 is removably connected to the support arms via the snap fasteners 36. The rotatable bezel 14 rotates in the bezel channel 34. Therefore, the rotatable bezel 14 rotates around the watch face 12 in conjunction with the rotation of the second hand 22. The snap fasteners 36 allow the user to interchange the rotatable bezel 14 with additional rotatable bezels 50. Preferably, the rotatable bezel 14 is decorated with decorative gems 24 for enhancing the shine and gleam of the watch face 12.

Figure 8:
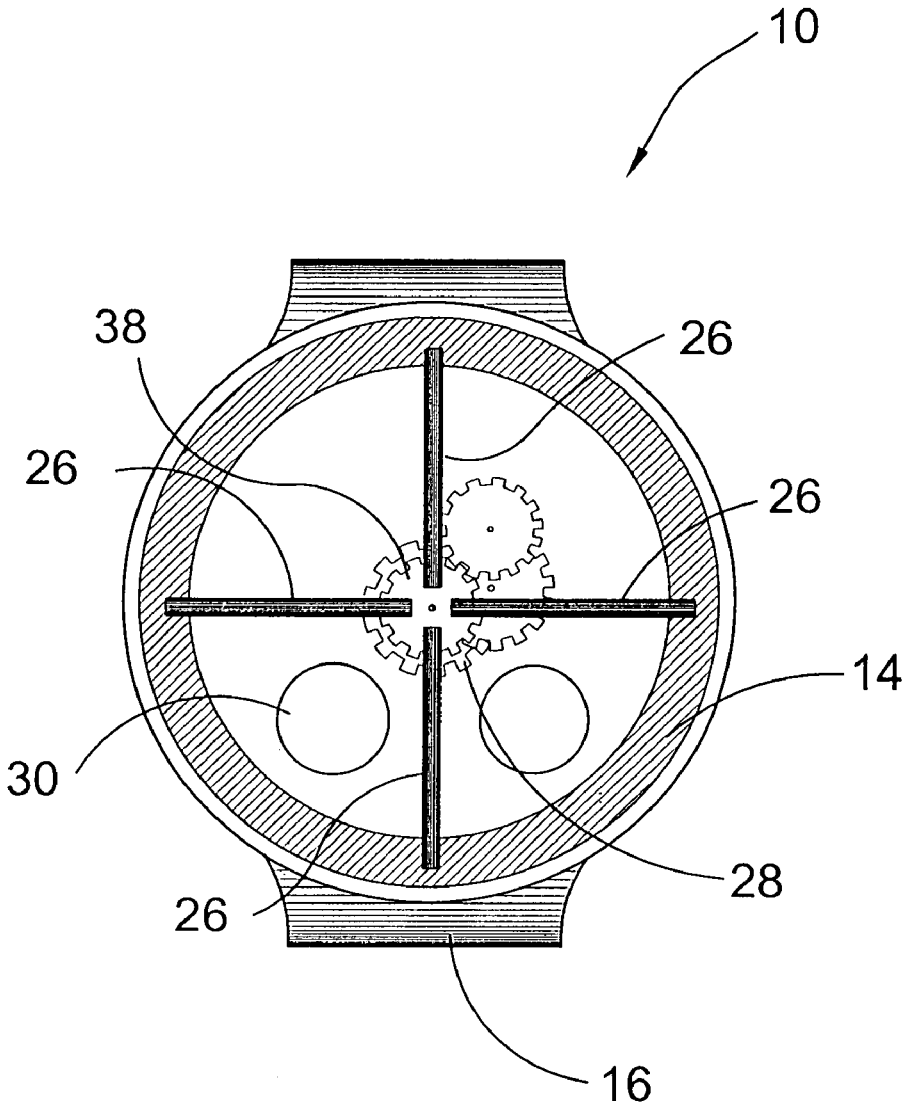
FIG. 8 is an alternate embodiment of the rotating bezel watch of the present invention.

FIG. 8 is an alternate embodiment of the rotating bezel watch 10 of the present invention. The rotating bezel watch 10 includes the watch face 12 connected to the watch band fastener 16 for wearing on the wrist, as shown in FIGS. 1–3. The present invention includes means for rotating the rotatable bezel 14 wherein the rotatable bezel 14 rotates in a circular motion around the outside of the watch face 12, as shown in FIG. 3. As shown in FIG. 8, the rotatable bezel 14 is connected to support arms 26. The support arms 26 are connected an additional drive gear 38, which is connected to the second hand gear 28. The power source 30 provides power for moving the second hand gear 28 in a clockwise motion in accordance with the movement of the second hand as a conventional timepiece. Therefore, the rotatable bezel 14 rotates around the watch face 12 in conjunction with the rotation of both the second hand gear 28 and the additional drive gear 38. Preferably, the additional drive gear 38 is connected to the second hand gear 28 at a gear ratio that causes the rotatable bezel 14 to rotate at a rate slower than the second hand. In an alternate embodiment, the additional drive gear 38 is connected to the second hand gear 28 at a gear ratio that causes the rotatable bezel 14 to rotate at a rate faster than the second hand. Preferably, the rotatable bezel 14 is decorated with decorative gems 24 for enhancing the shine and gleam of the watch face 12.

Figure 9:
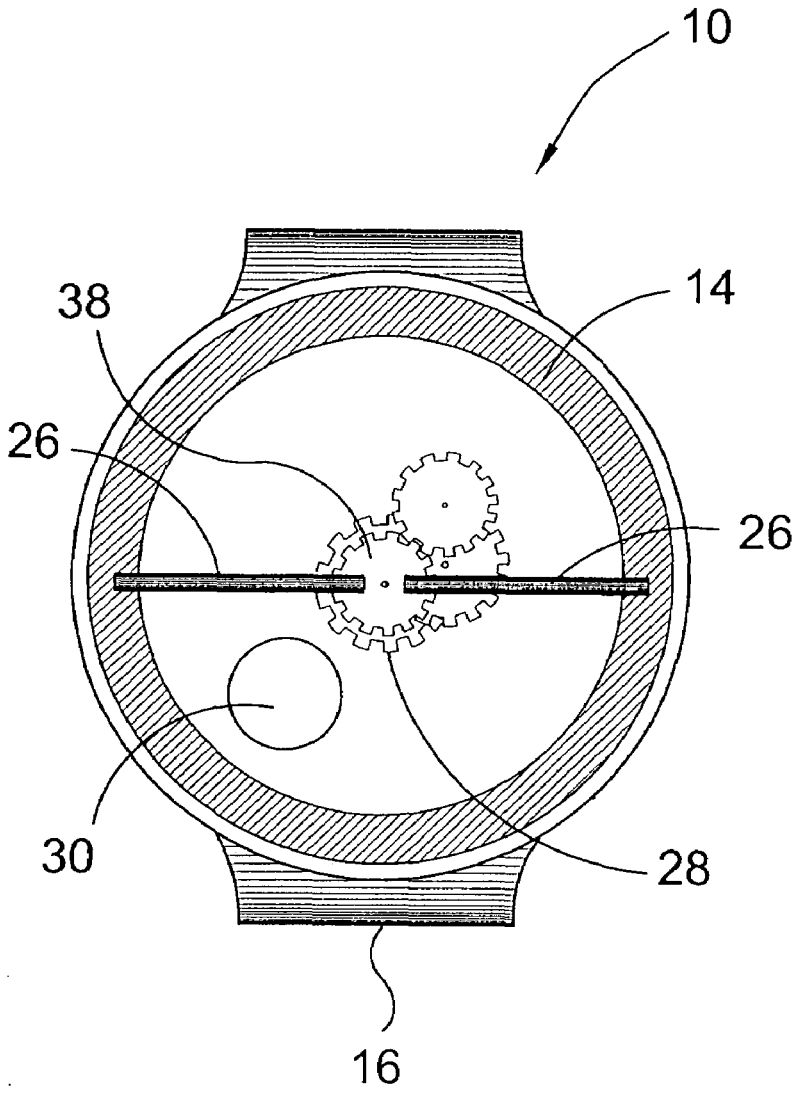
FIG. 9 is an alternate embodiment of the rotating bezel watch of the present invention.

FIG. 9 is an alternate embodiment of the rotating bezel watch 10 of the present invention. The rotating bezel watch 10 includes the watch face 12 connected to the watch band fastener 16 for positioning on the wrist of a user. The hour hand 20, second hand 22, and minute hand 32 are connected at one end of each to substantially the center of the watch face 12. Each of the hour hand 20, second hand 22 and minute hand 32 rotate in a clockwise direction around the watch face 12, as is typical in the art. The transparent cover 18 covers and protects the watch face 12. In a preferred embodiment, the transparent cover 18 is formed from crystal. The present invention includes means for rotating the rotatable bezel 14 wherein the rotatable bezel 14 rotates in a circular motion about the watch face 12. Preferably, the rotatable bezel 14 is connected to a second hand gear 28, as shown in FIG. 4. Therefore, the rotatable bezel 14 rotates about the watch face 12 in conjunction with the rotation of the second hand 22. Preferably, the rotatable bezel 14 is decorated with decorative gems 24 for enhancing the shine and gleam of the watch face 12.

Figure 10:
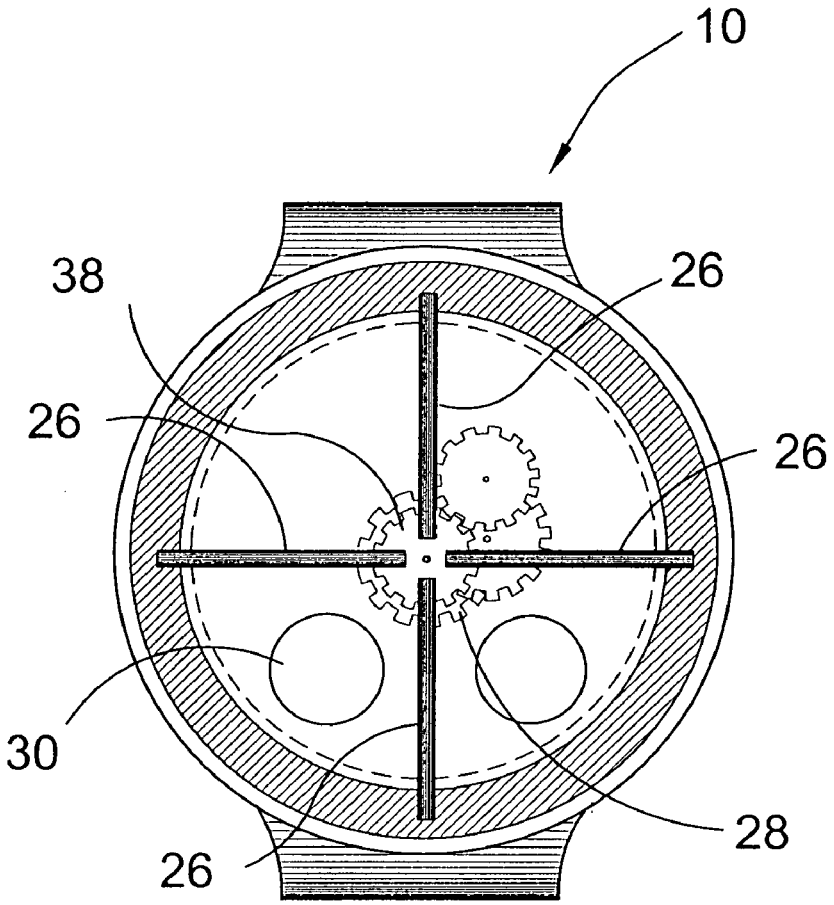
FIG. 10 is an alternate embodiment of the rotating bezel watch of the present invention.

FIG. 10 is an alternate embodiment of the rotating bezel watch 10 of the present invention. The rotating bezel watch 10 includes the watch face 12 connected to the watch band fastener 16 for positioning on the wrist of a user, as shown in FIGS. 1–3. The present invention includes means for rotating a rotatable bezel 14 wherein the rotatable bezel 14 rotates in a circular motion around the outside of the watch face 12, as shown in FIG. 3. In the alternate embodiment shown in FIG. 8, the rotatable bezel 14 is connected to support arms 26. The support arms 26 are connected an additional drive gear 38, which is connected to the second hand gear 28. A power source 30 provides power for moving the second hand gear 28 in a clockwise motion in accordance with the movement of the second hand as is typical in timepieces. Therefore, the rotatable bezel 14 rotates around the watch face 12 in conjunction with the rotation of the additional drive gear 38. Preferably, the additional drive gear 38 is connected to the second hand gear 28 at a gear ratio that causes the rotatable bezel 14 to rotate at a rate slower than the second hand. In an alternate embodiment, the additional drive gear 38 is connected to the second hand gear 28 at a gear ratio that causes the rotatable bezel 14 to rotate at a rate faster than the second hand. Preferably, the rotatable bezel 14 is decorated with decorative gems 24 for enhancing the shine and gleam of the watch face 12.

Figure 11:
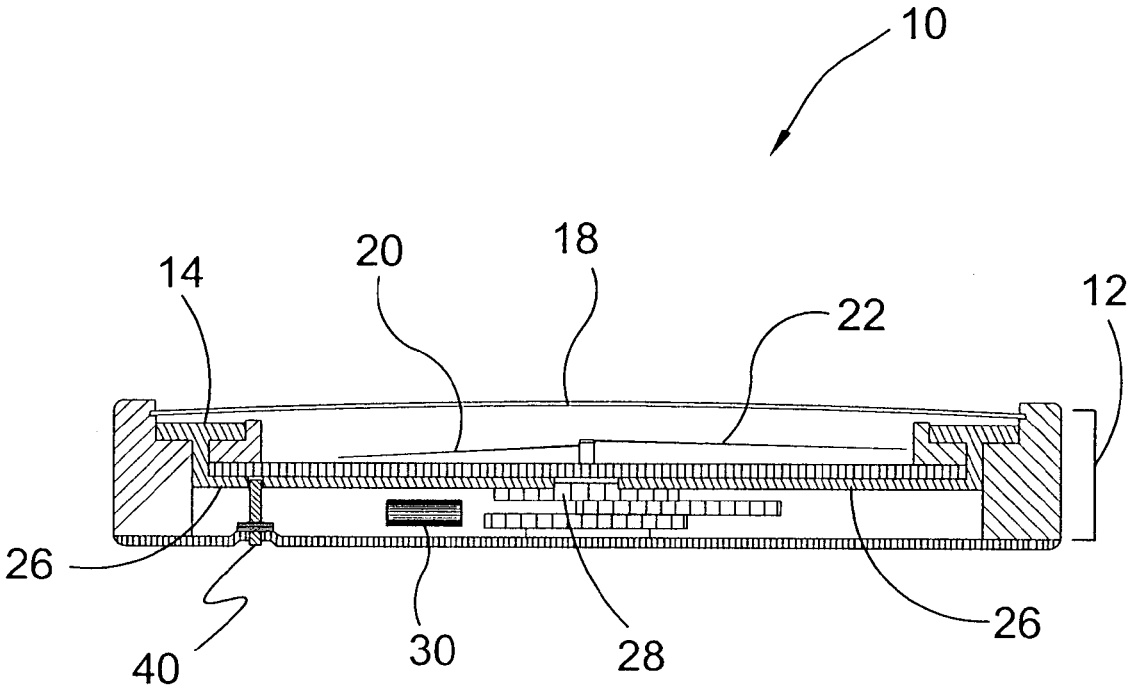
FIG. 11 is a sectional view of the rotating bezel watch of the present invention with an additional element.

FIG. 11 is a sectional view of the rotating bezel watch 10 of the present invention with an additional element. The rotating bezel watch 10 includes a watch face 12 connected to a watch band fastener 16 for wearing on the wrist, as shown in FIGS. 1–3. An hour hand 20 and a second hand 22 are connected at one end to the center of a watch face 12 and rotate in a clockwise direction around the watch face 12, as is typical in the art. A transparent cover 18 covers and protects the watch face 12. In a preferred embodiment, the transparent cover 18 includes crystal. A present invention includes means for rotating the rotatable bezel 14 wherein the rotatable bezel 14 rotates in a circular motion around the outside of the watch face 12. In a preferred embodiment, the rotatable bezel 14 is connected to the second hand gear 28. A power source 30 provides power for moving the second hand gear 28 in a clockwise motion in accordance with the movement of the second hand as is typical in timepieces. Therefore, the rotatable bezel 14 rotates around the watch face 12 in conjunction with the rotation of the second hand 22. A bezel disconnect button 40 is connected to the watch face 12. The bezel disconnect button 40 is positioned so that upon pressing the bezel disconnect button 40, the rotatable bezel 14 is released from the second hand gear 28, and therefore, ceases to rotate.

Figure 12:
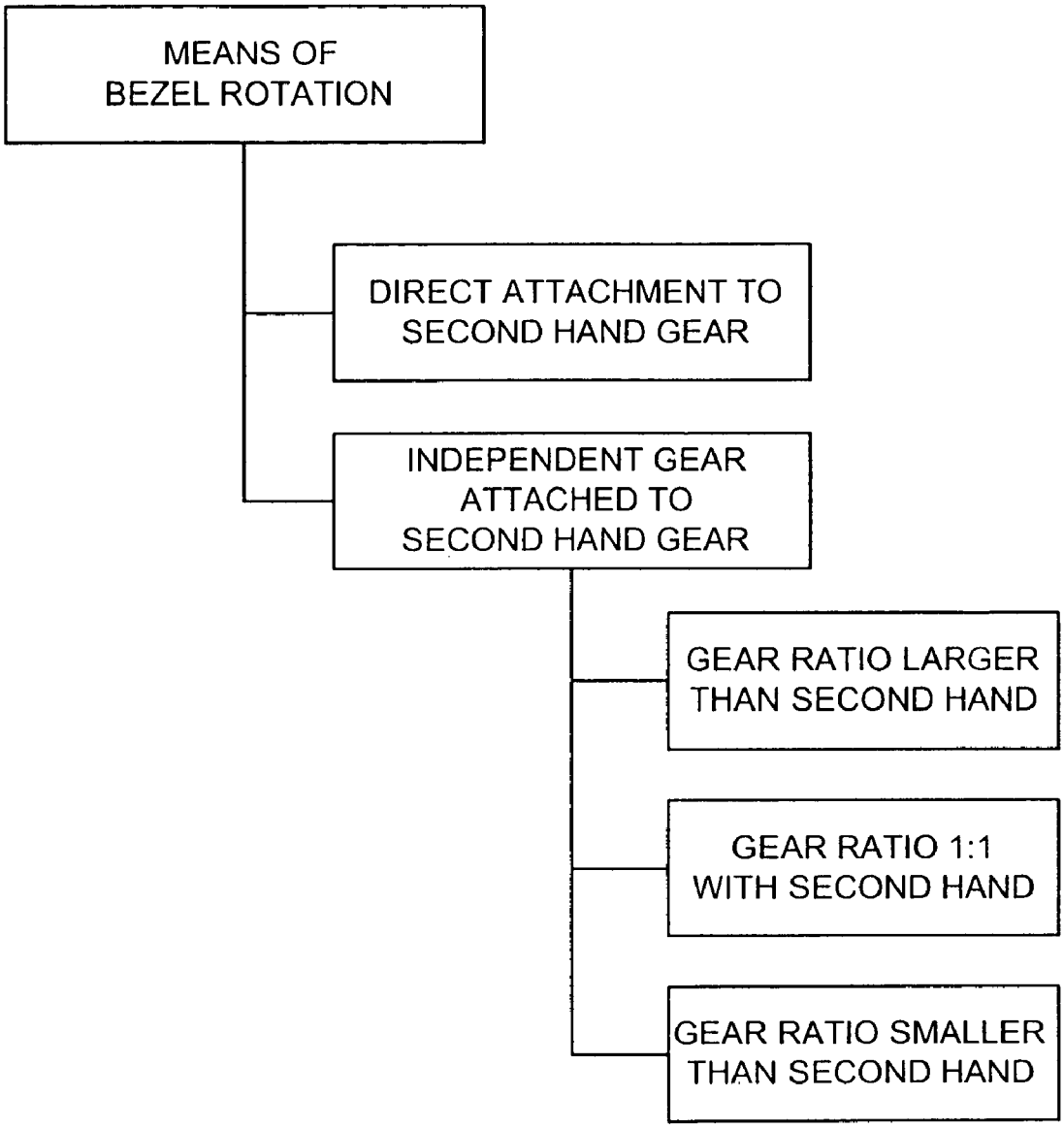
FIG. 12 is a block diagram of the means of rotation of the rotating bezel watch.

FIG. 12 is a block diagram of the means of bezel rotation of the rotating bezel watch of the present invention. The bezel may be attached in one of two ways. The bezel may be attached directly to the second hand gear or the bezel may be attached to an independent gear connected to the second hand gear of the timepiece. If the bezel is attached to an independent gear, the independent gear may include a gear ratio larger than the gear ratio of the second hand gear. The independent gear may also include a gear ratio greater than the gear ratio of the second hand gear. The independent gear may also include a gear ratio equal to the gear ratio of the second hand gear. The independent gear may also include a gear ratio smaller than the gear ratio of the second hand gear.

Figure 13:
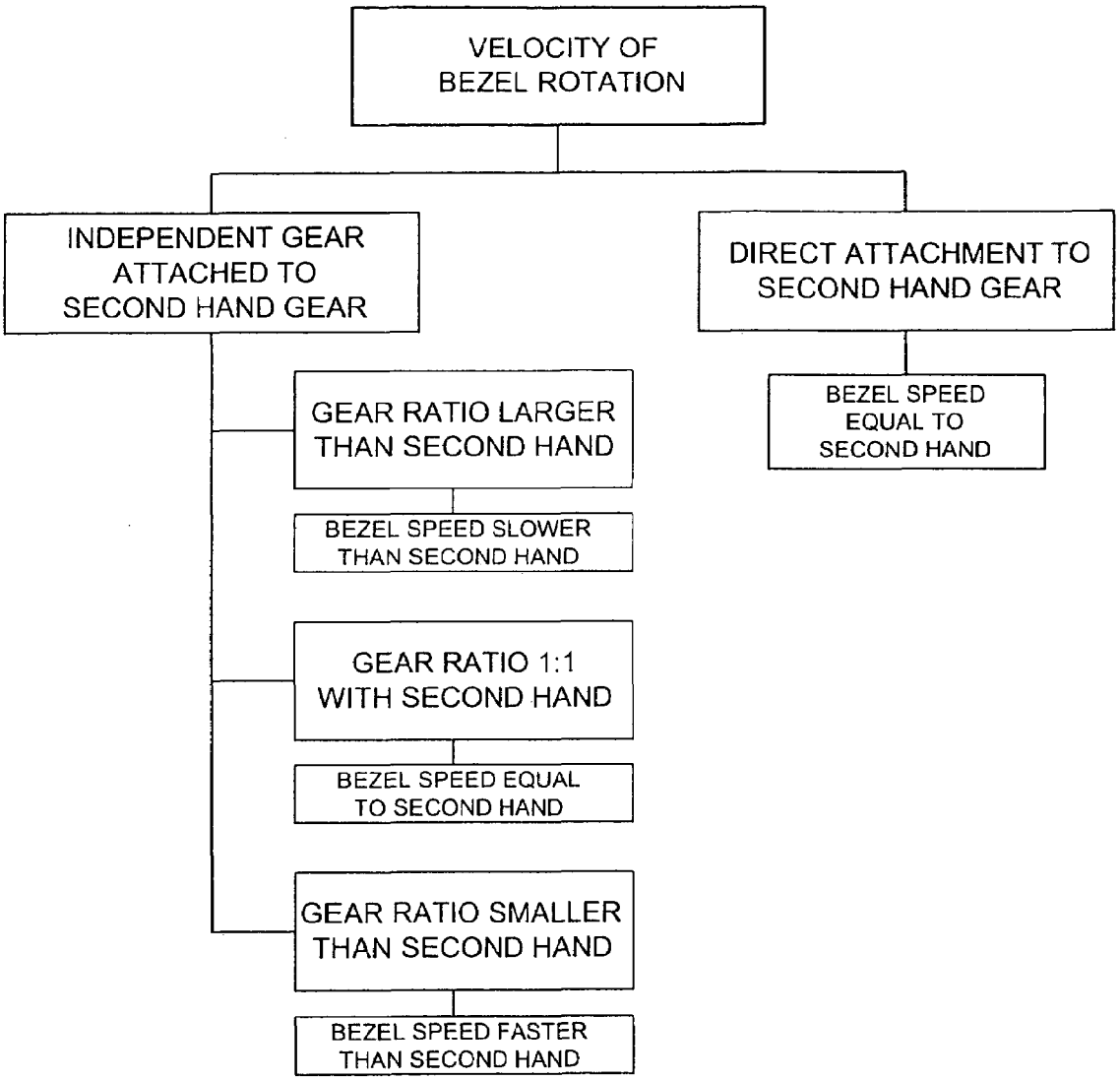
FIG. 13 is a block diagram of the velocity of bezel rotation of the rotating bezel watch.

FIG. 13 is a block diagram of the velocity of bezel rotation of the rotating bezel watch 10 of the present invention. The bezel may be attached in one of two ways. The bezel may be attached directly to the second hand gear or the bezel may be attached to an independent gear connected to the second hand gear of the timepiece. If the bezel is attached directly to the second hand gear, then the bezel rotation speed is equal to the rotation speed of the second hand. If the bezel is attached to an independent gear, the independent gear may include a gear ratio larger than the gear ratio of the second hand gear. The independent gear may also include a gear ratio greater than the gear ratio of the second hand gear. If the gear ratio is greater than the gear ratio of the second hand gear, then the bezel rotation speed is slower than the rotation speed of the second hand. The independent gear may also include a gear ratio equal to the gear ratio of the second hand gear. If the gear ratio is equal to the gear ratio of the second hand gear, then the bezel rotation speed is equal to the rotation speed of the second hand. The independent gear may also include a gear ratio smaller than the gear ratio of the second hand gear. If the gear ratio is smaller than the gear ratio of the second hand gear, then the bezel rotation speed is faster than the rotation speed of the second hand.

Figure 14:
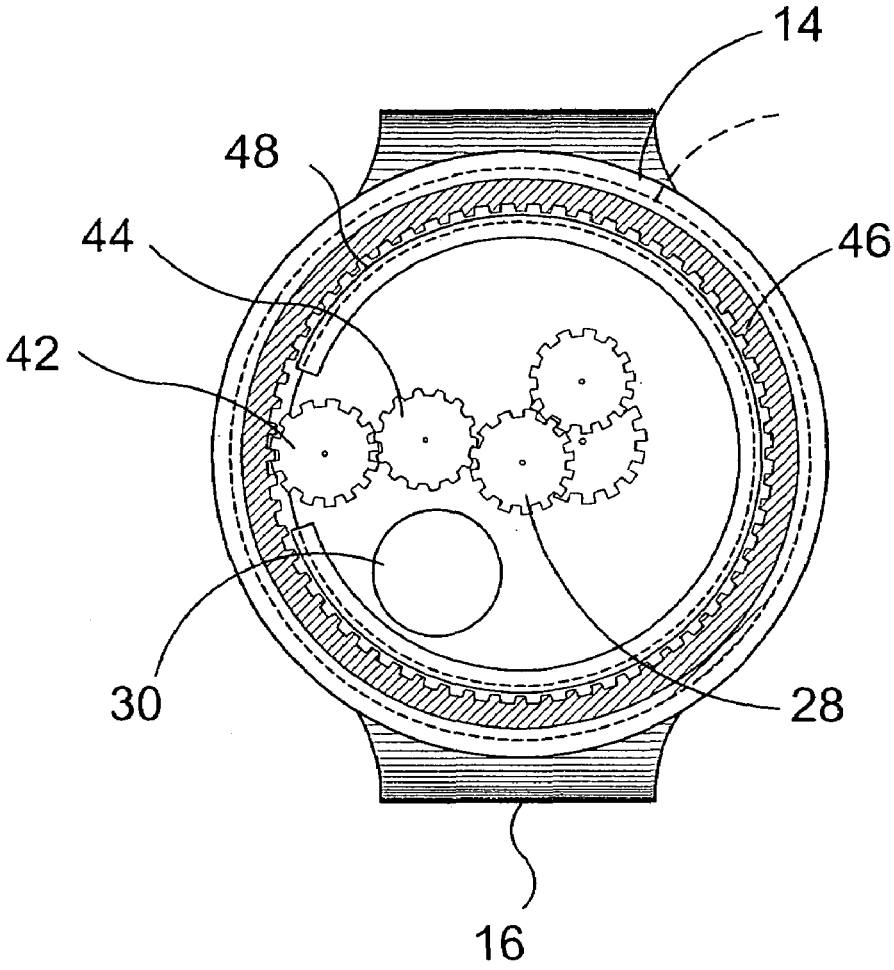
FIG. 14 is a rear view of the rotating bezel watch of the present invention with an alternate bezel drive mechanism.

FIG. 14 is a rear view of the present invention with an alternate bezel drive mechanism. The rotating bezel watch 10 includes the watch face 12 connected to the watch band fastener 16 for wearing on the wrist, as shown in FIGS. 1–3. The present invention includes means for rotating a rotatable bezel 14 wherein the rotatable bezel 14 rotates in a circular motion around the outside of the watch face 12, as shown in FIG. 3. In the alternate embodiment shown in FIG. 14, the rotatable bezel 14 is connected to a geared bezel cylinder 46. A second hand gear 28 meshes with a transitional gear 44. The transitional gear 44 meshes with a bezel drive gear 42. The bezel drive gear 42 meshes with the interior teeth of the geared bezel cylinder 46. A power source 30 provides power for moving the second hand gear 28 in a clockwise motion in accordance with the movement of the second hand as is typical in timepieces. Therefore, the rotatable bezel 14 rotates around the watch face 12 in conjunction with the rotation of the bezel drive gear 42, the transitional gear 44, and the second hand gear 28. Preferably, a transparent cover support 48 is connected to the watch face to removeably support the transparent cover 18, as shown in FIG. 3.

Figure 15:
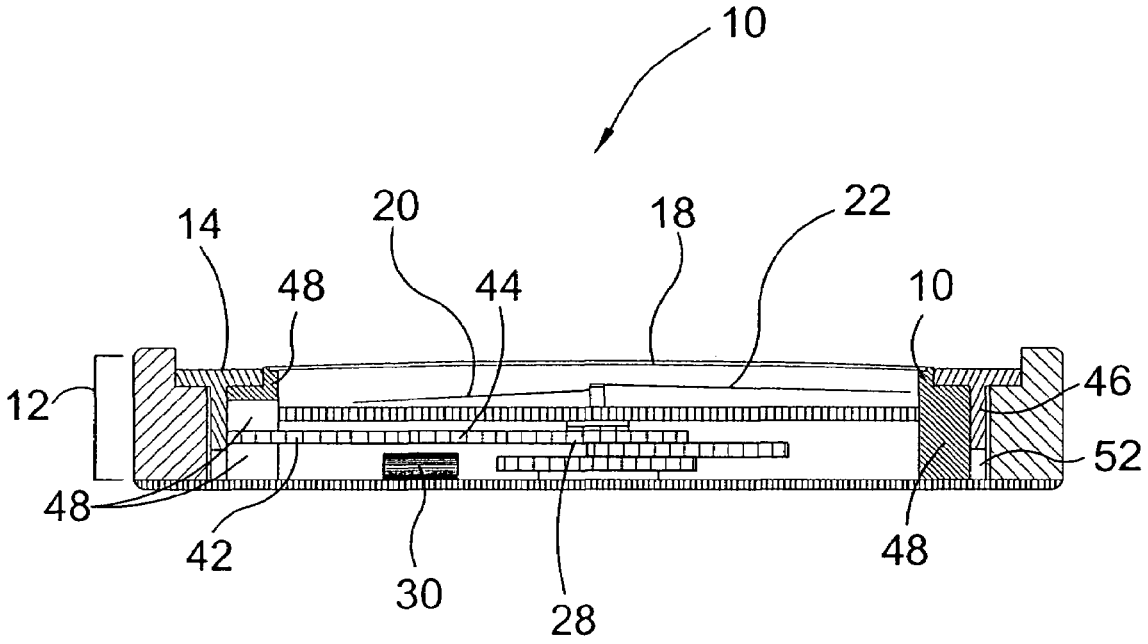
FIG. 15 is a sectional view of the rotating bezel watch of the present invention with an alternate bezel drive mechanism.

FIG. 15 is a cross sectional view of the rotating bezel watch 10 of the present invention with an alternate bezel drive mechanism. The rotating bezel watch 10 includes a watch face 12 connected to a watch band fastener 16 for wearing on the wrist, as shown in FIGS. 1–3. A present invention includes means for rotating a rotatable bezel 14 wherein the rotatable bezel 14 rotates in a circular motion around the outside of the watch face 12, as shown in FIG. 3. In the alternate embodiment shown in FIG. 15, the rotatable bezel 14 is connected to a geared bezel cylinder 46. The geared bezel cylinder 46 is positioned within a cylinder channel 52. A second hand gear 28 meshes with a transitional gear 44. The transitional gear 44 meshes with a bezel drive gear 42. The bezel drive gear 42 meshes with the interior teeth of the geared bezel cylinder 46. A power source 30 provides power for moving the second hand gear 28 in a clockwise motion in accordance with the movement of the second hand as is typical in timepieces. Therefore, the rotatable bezel 14 rotates around the watch face 12 in conjunction with the rotation of the bezel drive gear 42, the transitional gear 44, and the second hand gear 28. Preferably, a transparent cover support 48 is connected to the watch face to removeably support the transparent cover 18, as shown in FIG. 3.

Figure 16:
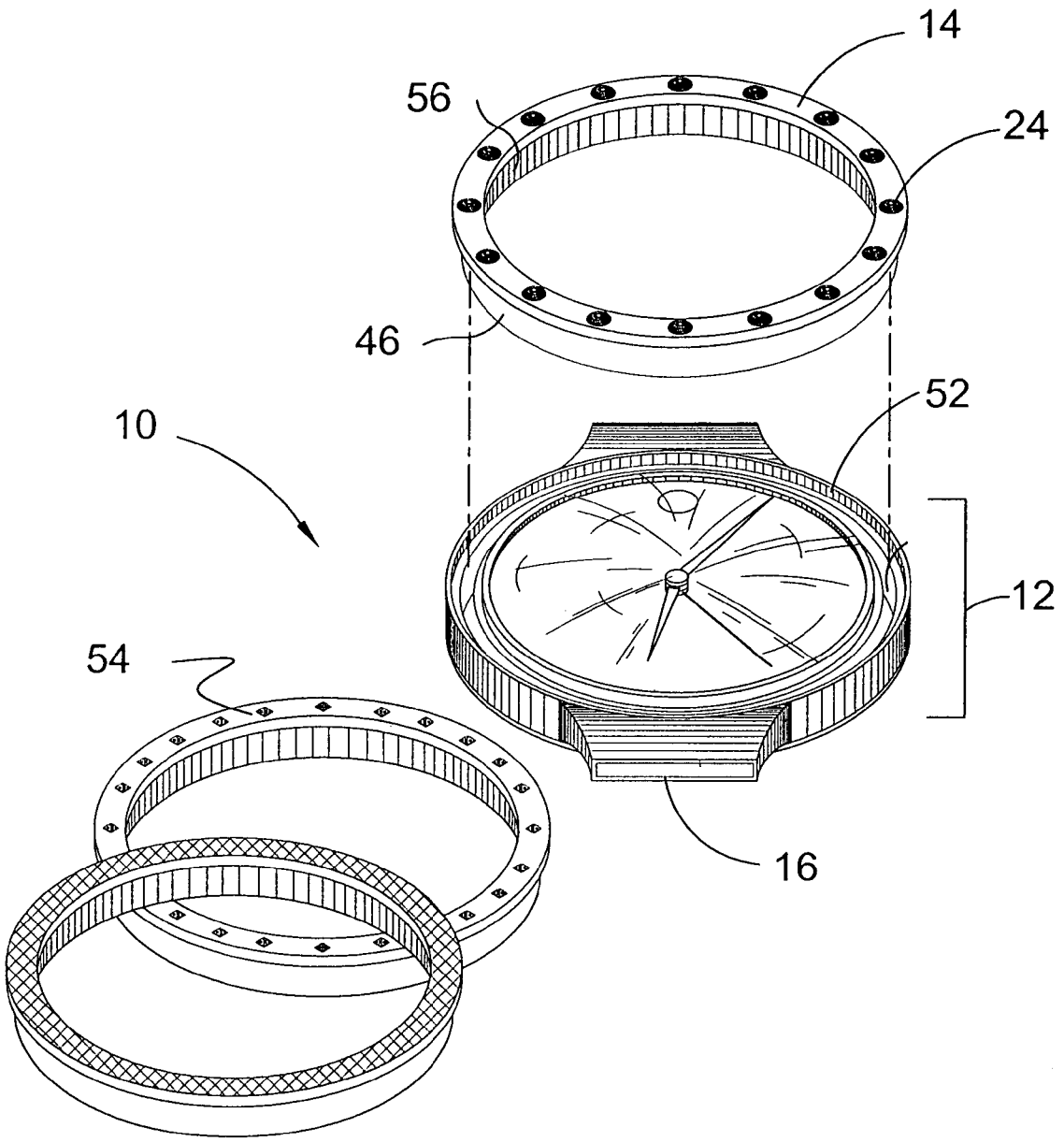
FIG. 16 is a perspective view of the rotating bezel watch of the present invention with an alternate bezel drive mechanism and an additional element.

FIG. 16 is a perspective view of the rotating bezel watch 10 of the present invention with an alternate bezel drive mechanism and an additional element. The rotating bezel watch 10 includes a watch face 12 connected to a watch band fastener 16 for wearing on the wrist, as shown in FIGS. 1–3. A present invention includes means for rotating a rotatable bezel 14 wherein the rotatable bezel 14 rotates in a circular motion around the outside of the watch face 12, as shown in FIG. 3. In the alternate embodiment shown in FIG. 16, the rotatable bezel 14 is connected to a geared bezel cylinder 46. The geared bezel cylinder 46 is positioned within a cylinder channel 52. A bezel drive gear 42 meshes with the gear teeth 56 of the geared bezel cylinder 46, thereby driving the rotation of the bezel, as shown in FIGS. 14 and 15. Preferably, the rotatable bezel 14 can be interchanged with additional rotational bezels 54. Preferably, the rotatable bezel 14 is decorated with decorative gems 24 for enhancing the shine and gleam of the watch face 12.

Figure 17:
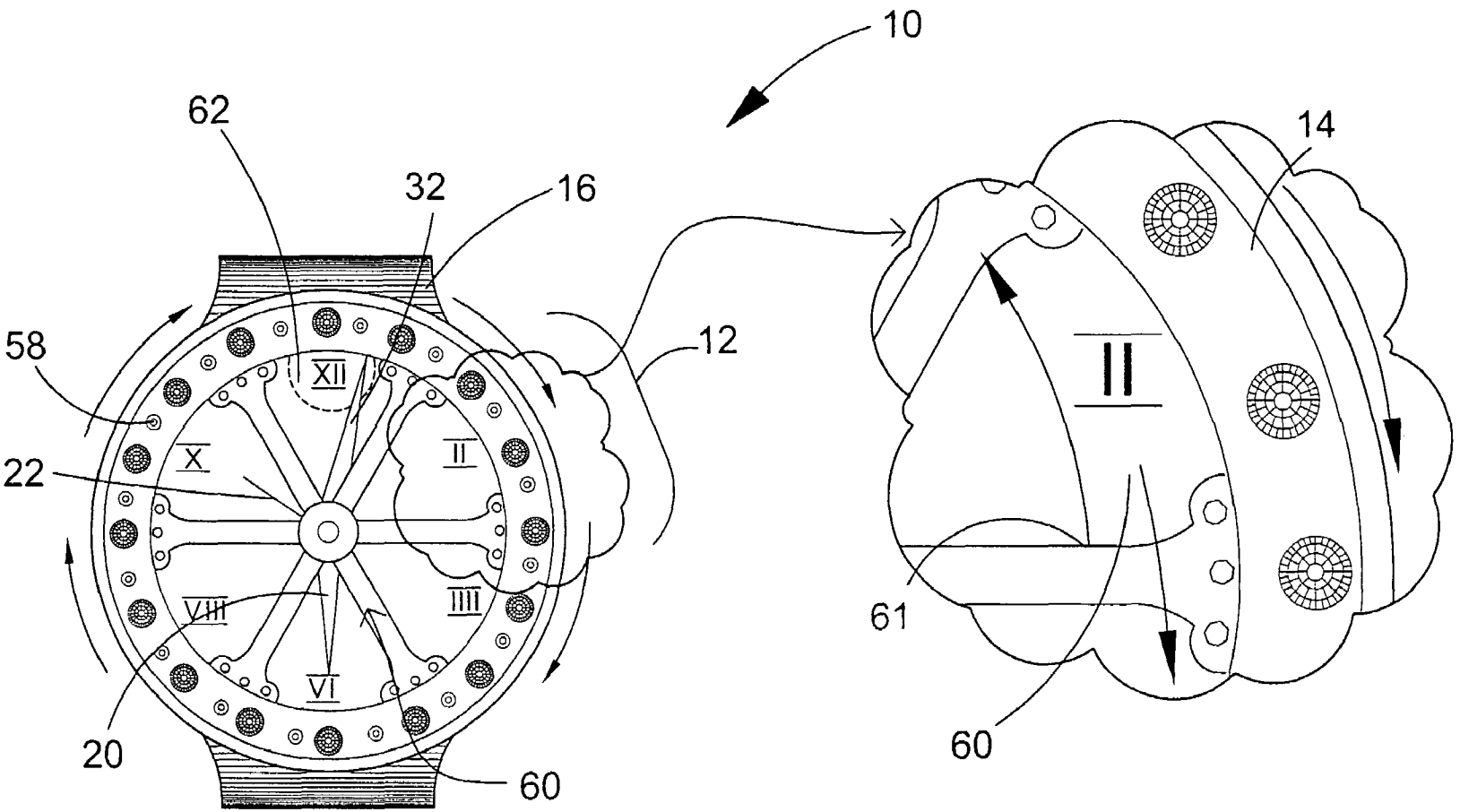
FIG. 17 is an additional element of the rotating bezel watch of the present invention.

FIG. 17 is an additional element of the rotating bezel watch 10 of the present invention. The rotating bezel watch 10 includes a watch face 12 connected to a watch band fastener 16 for wearing on the wrist, as shown in FIGS. 1–3. The present invention includes means for rotating a rotatable bezel 14 wherein the rotatable bezel 14 rotates in a circular motion around the outside of the watch face 12. The rotatable bezel 14 rotates around the watch face 12 in conjunction with the rotation of the gears of the timepiece. In the alternate embodiment shown in FIG. 17, a fixed number plate 62 is connected to the watch face 12. Additionally, a rotating bezel face plate 60 is connected to the gears of the timepiece. The rotating bezel face plate 60 may move in conjunction with or independently from the rotatable bezel 14. Preferably, the rotatable bezel 14 is decorated with decorative gems 24 for enhancing the shine and gleam of the watch face 12. Additionally, the rotatable bezel is decorated with light emitting diodes 58.

Figure 18:
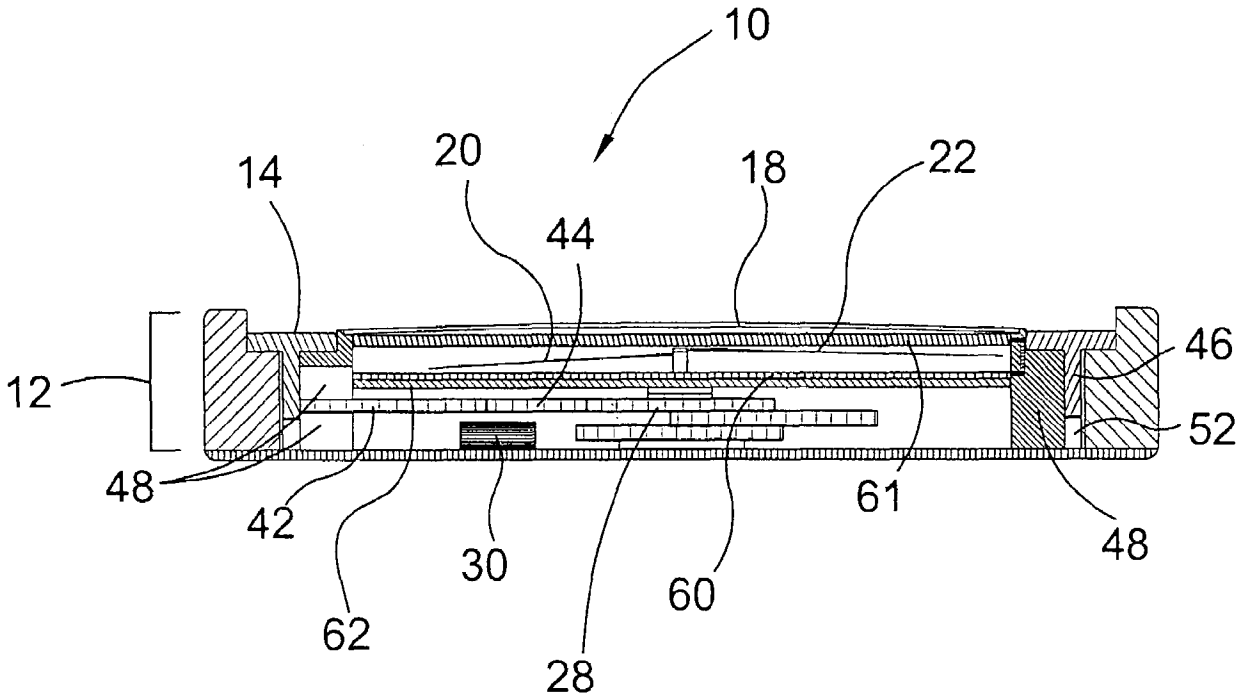
FIG. 18 is a sectional view of an additional element of the rotating bezel watch of the present invention.

FIG. 18 is a sectional view of an additional element of the rotating bezel watch 10 of the present invention. The rotating bezel watch 10 includes a watch face 12 connected to a watch band fastener 16 for wearing on the wrist, as shown in FIGS. 1–3. A present invention includes means for rotating a rotatable bezel 14 wherein the rotatable bezel 14 rotates in a circular motion around the outside of the watch face 12, as shown in FIG. 3. In the alternate embodiment shown in FIG. 15, the rotatable bezel 14 is connected to a geared bezel cylinder 46. The geared bezel cylinder 46 is positioned within a cylinder channel 52, as shown in FIG. 16. A second hand gear 28 meshes with a transitional gear 44. The transitional gear 44 meshes with a bezel drive gear 42. The bezel drive gear 42 meshes with the interior teeth of the geared bezel cylinder 46. A power source 30 provides power for moving the second hand gear 28 in a clockwise motion in accordance with the movement of the second hand as is typical in timepieces. Therefore, the rotatable bezel 14 rotates around the watch face 12 in conjunction with the rotation of the bezel drive gear 42, the transitional gear 44, and the second hand gear 28. Preferably, a transparent cover support 48 is connected to the watch face to removeably support the transparent cover 18, as shown in FIG. 3. In the alternate embodiment shown in FIG. 18, a fixed number plate 62 is connected to the watch face 12. Additionally, a rotating bezel face plate 60 is connected to the gears of the timepiece. Therefore, the rotating bezel face plate 60 may move in conjunction with or independently from the rotatable bezel 14.

The following discussion describes in detail one embodiment of the invention. This discussion should not be construed, however, as limiting the invention to those particular embodiments; practitioners skilled in the art will recognize numerous other embodiments as well. For definition of the complete scope of the invention, the reader is directed to appended claims.

What is claimed is new and desired to be protected by Letters Patent is set forth in the appended claims:

1. A rotating bezel wrist watch comprising:

a) a watch face on said wrist watch having an hour hand, minute hand and second hand connected at substantially a center thereof and enclosed in a casing with an opening for said watch face and having wrist band fasteners;

b) a rotatable bezel connected to said watch face mounted on an annular shoulder of said casing surrounding said watch face so that a portion of said bezel overlaps said watch face;

c) a transparent cover mounted on said casing enclosing said watch face and said bezel; and d) means connected to said second hand for rotating said rotatable bezel along said shoulder, wherein said rotating means visibly rotates said rotatable bezel about said watch face to increase the visual attractiveness of said watch face.

2. The rotating bezel watch as recited in claim 1, wherein said rotatable bezel includes a plurality of decorative elements.

3. The rotating bezel watch as recited in claim 2, wherein said decorative elements are jewels.

4. The rotating bezel watch as recited in claim 2, wherein said decorative elements are light emitting diodes.

5. The rotating bezel watch as recited in claim 1, wherein said rotating means comprises a second hand gear connected to said second hand of the wrist watch, wherein said rotating bezel is connected to said second hand gear by connecting means.

6. The rotating bezel watch as recited in claim 5, wherein said connecting means comprises radially extending support arms connected between said rotating bezel and said second band gear.

7. The rotating bezel watch as recited in claim 5, wherein said connecting means comprises a plurality of intermeshed gears.

8. The rotating bezel watch as recited in claim 1, wherein said rotating means comprises a second hand gear connected to said second hand and to an independent gear connected to said rotating bezel by connecting means.

9. The rotating bezel watch as recited in claim 8, wherein said connecting means comprises support arms connected between said rotating bezel and said independent gear.

10. The rotating bezel watch as recited in claim 8, wherein second hand gear is connected to said independent gear with a gear ratio greater than the gear ratio of said second hand gear.

11. The rotating bezel watch as recited in claim 8, wherein second hand gear is connected to said independent gear with a gear ratio less than the gear ratio of said second hand gear.

12. The rotating bezel watch as recited in claim 8, wherein second hand gear is connected to said independent gear with a gear ratio equal to the gear ratio of said second hand gear.

13. The rotating bezel watch as recited in claim 1, further comprising a bezel disconnect button on an underside of said casing for selectively releasing said rotatable bezel from said rotating means.

14. The rotating bezel watch as recited in claim 1, wherein said rotatable bezel is selectively interchangeable.

15. The rotating bezel watch as recited in claim 1, further comprising a rotating bezel face plate.

* * * * *